US006315167B2

(12) United States Patent
Brecheisen et al.

(10) Patent No.: US 6,315,167 B2
(45) **Date of Patent: *Nov. 13, 2001**

(54) BAYONET-TYPE FINISH FOR A CONTAINER

(75) Inventors: William W. Brecheisen, Findlay; Eugene F. Haffner, Waterville; James E. Hiltner, Sylvania; Wing-Kwong Keung, Perrysburg; Anthony J. Scott, Maumee; George R. Trepina, Holland, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/729,276

(22) Filed: Dec. 5, 2000

Related U.S. Application Data

(63) Continuation of application No. 09/304,883, filed on May 4, 1999, now Pat. No. 6,155,462.

(51) Int. Cl.[7] ..... B67B 5/00

(52) U.S. Cl. ..... 222/153.09; 222/383.1; 215/332; 215/276

(58) Field of Search ..... 222/153.09, 383.1, 222/321.7; 220/293, 297, 300; 215/332, 222, 274, 276, 318

(56) References Cited

U.S. PATENT DOCUMENTS

| | | | | |
|---|---|---|---|---|
| 3,339,770 | * | 9/1967 | Weigand | 215/222 |
| 4,335,823 | * | 6/1982 | Montgomery et al. | 215/318 |
| 5,238,152 | * | 8/1993 | Maas et al. | 222/153 |
| 5,810,209 | * | 9/1998 | Foster | 222/383.1 |

FOREIGN PATENT DOCUMENTS

| | | | | |
|---|---|---|---|---|
| 8203058 | * | 9/1982 | (WO) | 215/332 |

* cited by examiner

*Primary Examiner*—Kevin Shaver
*Assistant Examiner*—Melvin A. Cartagena

(57) ABSTRACT

Finish has bayonet provisions, each including axial catch portions, stop, rib and detent ridge downward from the distal end of the catch portion. Finish also has ramp provisions, each including axial stop and sloping wedge portion extending down from top of axial stop and sloping at 40° from an imaginary circumferential line at the base of the wedge portion. The stops, detent ridges and wedges all provide tactile notification to user as to where lugs on a cooperant cap are vis-a-vis catch portion and top of finish.

2 Claims, 2 Drawing Sheets

BAYONET-TYPE FINISH FOR A CONTAINER

CROSS-REFERENCE TO RELATED APPLICATION

This application is a continuation of Ser. No. 09/304,883 filed May 4, 1999, now U.S. Pat. No. 6,155,462.

FIELD OF THE INVENTION

This invention relates to a bayonet-type finish for a container. More specifically, the invention relates to a finish including about its circumference alternating bayonet provisions including peripheral stops, catch portions and detent ridges, and ramp provisions, all of which give to the user tactile notification of the condition of the closure; i.e., whether it is fully locked on, approaching locked condition or removal, or completely separated from the finish.

BACKGROUND OF THE INVENTION

The prior art is replete with disclosures of finishes and caps for bottles. Most of these are screw-type. More recently, the art has expanded in the direction of bayonet-type finishes and caps. The latter are coming into their own, partly because of the ease of molding the closures which require only two diametrically opposed inward lugs instead of threads. Threaded caps have to be "screwed off" the mold core. With lugged caps, lugs can be formed by mold pins which intrude into the space inside the cap through the top wall of the cap, leaving after molding inoffensive openings in the top wall of the cap outside the plug-type seal. Such lug-type caps are easy to pop out of the mold, and there is substantial savings in mold time.

A drawback of lug-type caps is that, because the lugs and bayonet catch portions are not visible to the user, it has been a matter of speculation for him to determine just where in the locking or unlocking process the cap and bottle are at a given time. In other words, there has been a need for better tactile notification to the user of the position of the lugs are as he manipulates the cap on the finish.

SUMMARY OF THE INVENTION

The present invention is defined in the claims. Briefly, for use with a cap having inward lugs in its skirt, the invention is a container including a cylindrical finish having bayonet provisions, each comprising a first rib-like stop portion extending parallel to the axis of the finish and a catch portion extending from the stop portion circumferentially of the cylindrical finish to a distal end. The catch portion has an outwardly and downwardly sloping upper surface portion, and a radial lower surface. A detent ridge runs downward from the distal end of the catch portion. The finish further includes ramp provisions, each comprising a second rib-like stop portion extending parallel to the axis of the finish and a wedge-like shape extending from the upper end of the stop portion downward toward the distal end of the catch portion. The wedge-like shape has a sloping surface facing the distal end, the sloping surface extending from below the catch portion to above the catch portion and sloping at an angle of about 40° to an imaginary circumfrential line passing through the sloping surface.

BRIEF DESCRIPTION OF THE DRAWINGS

Further objects and features of the invention will be clear to those skilled in the art from a review of the following specification and drawings, all of which present a non-limiting form of the invention. In the drawings.

Figure 1:
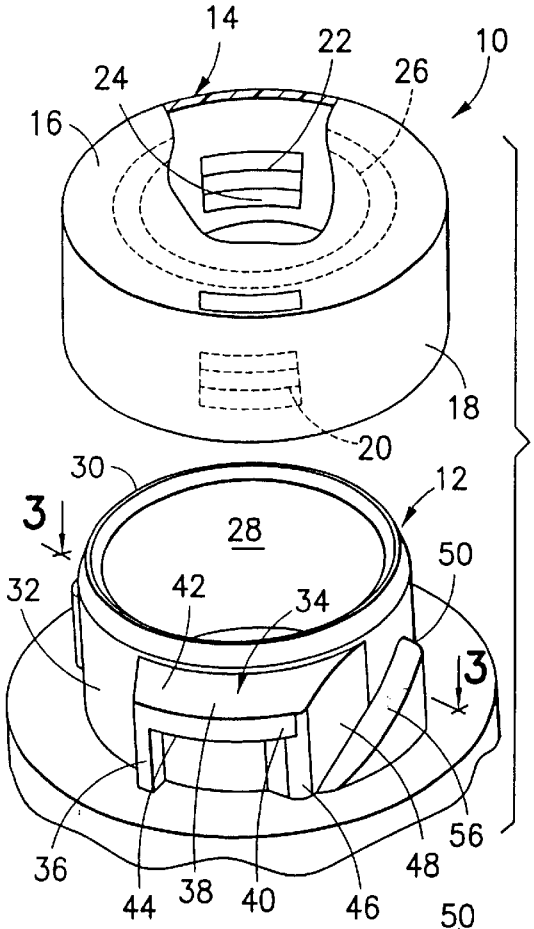
FIG. 1 is an exploded perspective view of a cap and finish embodying the invention, the top wall of the cap being broken away to expose one of the inward lugs and the finish being shown without the remainder of the container.

The bayonet provision also includes a catch portion 38 extending from the stop portion 36 circumferentially of the cylindrical finish to a distal end 40. The catch portion 38 includes an upper surface 42 comprising an outwardly and downwardly sloping portion and a lower surface 44 generally radial of the finish. Extending downward from the distal end 40 of the catch portion is the detent ridge 46 which is preferably rounded and includes a gently sloping portion 48 which tapers gradually into the outer surface 32 of the finish.

Figure 4:
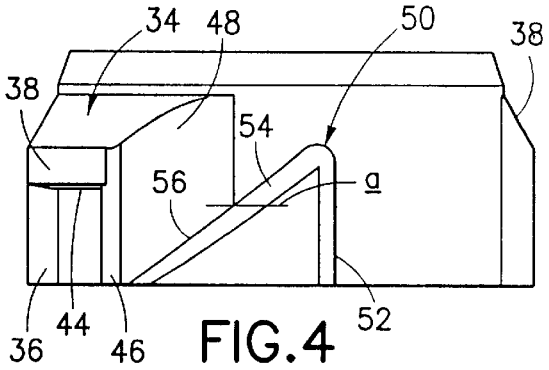
FIG. 4 is a side elevational view of the finish taken generally from the right side as viewed from FIG. 1.
Figure 3:
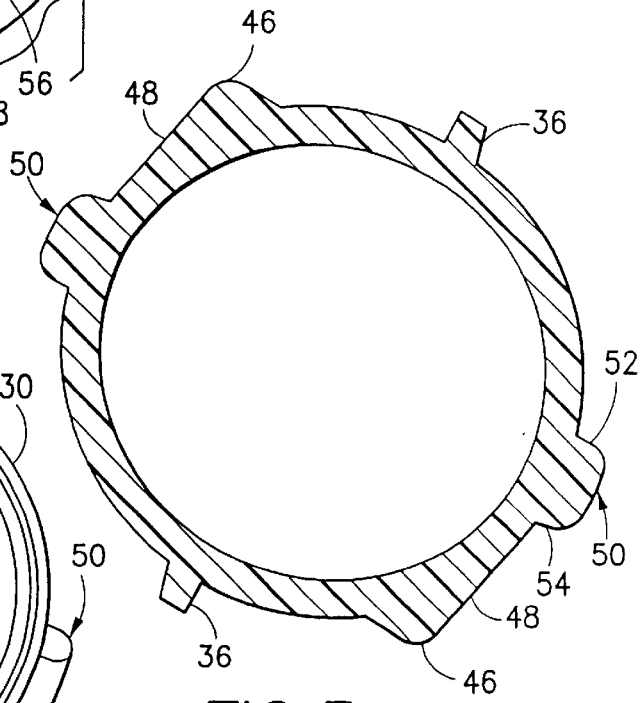
FIG. 3 is a sectional view taken on the line 3—3 showing the cap installed on the finish with the lugs of the cap engaging under the catch portions of the finish.
Figure 2:
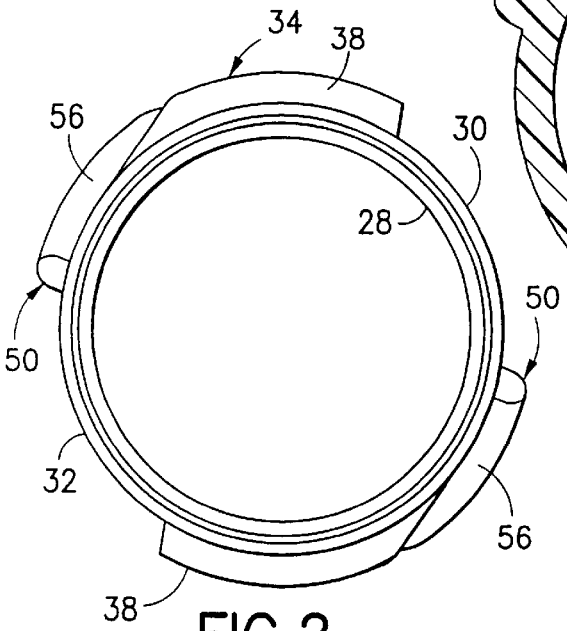
FIG. 2 is a top plan view of the finish.

The finish further includes a pair of outward ramp provisions 50 on the outer surface 32 of the finish. The ramp provisions 50 are at diametrically opposite positions on the finish (FIG. 3) between the bayonet provisions. The ramp provisions each comprise a second rib-like stop 52 extending parallel to the axis of the finish and a wedge-like shape 54 extending from the stop portion 52 toward the distal end of the catch portion most proximate in a clockwise direction viewed from above the finish. The wedge-like shape 54 includes a sloping surface 56 facing the distal end 40. The sloping surface 56 extends from below the catch portion 38 to above the catch portion and slopes at an angle of about 40° (FIG. 4) to an imaginary circumferential line passing through the sloping surface. In the preferred version the sloping portion 48 of the bayonet provision intersects the sloping surface 56 of the wedge portion.

In use, the cap 16 (FIG. 1) may be installed on the finish 12 by lining up the lugs 20 with the catch portions 38. Indica (not shown) on the finish base and cap will facilitate this. The cap may be pressed downward to distort the skirt 18, spreading the lugs 20 as the inclined surfaces 24 and 40 move along each other and the lugs 20 finally snap under the catch portions 38. In this action, the downward annular wall seal 26 fits snugly inside the mouth 28 of the finish sealing it so that liquid within the container cannot leak out.

Once installed, the cap 14 may be removed by rotating it counter-clockwise so that the lugs engage the detent ridges 46 and slide thereover as the skirt 18 again distorts outwardly. The lugs 20 then ride along the gently sloping surface 48 and encounter the inclined surface 56 of the ramp provisions 50. Further turning of the cap 14 will raise the cap, separating completely from the finish 12, giving tactile notification that the container is opened. Thereafter, product within the container may be dispensed through the mouth 28.

For re-installation of the cap 14 on the finish 12, the lugs may be lined up over an upper area of the inclined surface 56 and the cap 14 may be pushed down and rotated clockwise so that the wall 26 fits into the wall 30 and the lugs 20 encounter the detent ridges 46 and ride thereover so that the lugs underlie the catch portions 38, the upper surface 22 of the lugs engaging the undersurface 44 of the catch portions. Further turning of the cap will cause the lugs 20 to engage the stop ribs 36. Thus, the user has tactile notification that the cap is securely installed.

The nature of the detent ridges 46 can be modified. For a closure not to be removed at all, the ridges 46 can be more pronounced to serve as stops, blocking rotation in the counterclockwise direction. This may be useful where the closure is part of a pump dispenser, to be explained. A version of the finish may be provided wherein the ridge is pronounced enough to present an impediment so that a child is not sufficiently strong to turn the cap past the detent ridge, but an adult can. This version makes it a child-resistant closure.

Figure 5:
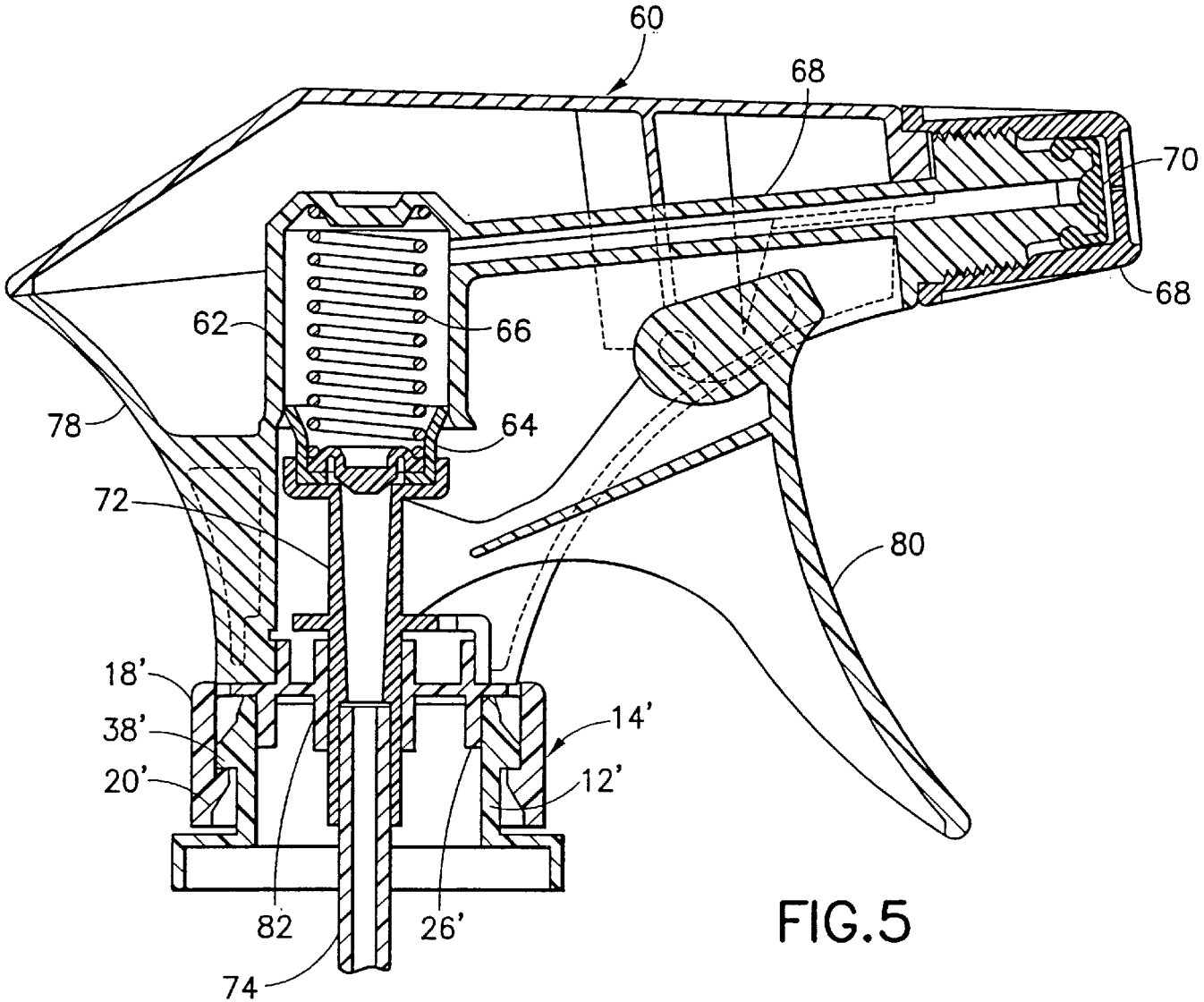
FIG. 5 is a sectional view of a pump dispenser having a closure installed on a finish embodying the invention.

FIG. 5 shows a cap 14' made unitarily with the body of a pump dispenser 60 of the type shown in the McKinney U.S. Pat. No. 4,227,650. The dispenser includes the pump cylinder 62, the piston 64, the return spring 66. A delivery tube 68 delivers product from the pump chamber to the nozzle 68 by way of the outlet check 70. From the piston 64 a tubular stem 72 extends downward can couples with a dip tube 74. The inlet check 76 controls inflow. The dispenser includes the lower body 78 which is unitarily former with a cap 14'. The upper wall of the cap has an opening 82 through which the stem reciprocably passes. The cap 14' includes an annular downward sealing wall 86 which fits within the finish 12'.

The cap 14' has a downward skirt formed with inward lugs 20' and the finish is provided with outward catch portions 38'.

In assembly, the pump dispenser 60 shown may be installed on the finish 12' by lining up the lugs 20' with the catch portions 38' and pressing downwardly. As explained, the downward skirt 18' will bulge outwardly, permitting the lugs to snap over the catch portions 38. The downward sealing wall 86 engages the inside of the mouth 28' to seal the pump on the container. The trigger 90, pivoted to the dispenser body, will raise the piston 64 to effect the pumping in the usual way.

An important advantage of the structure of the invention is the tactile notification to the user of the position of the lugs 20 relative to the provisions of the finish. The user when he encounters the closed container will detect that initially the lugs are between the stop 36 and the detent ridge 46. He can feel this by rotating the cap back and forth. The lug will hit the stop 36 in one direction and the detent ridge 46 in the other direction, and he can "feel" the hits. Turning the cap in a counterclockwise direction with force, the user will "feel" the surmounting of the detent ridge 46 and the gentle ride down the sloping surface 48. Then, finally, he will feel the raising of the cap as the lugs engage the inclined surface 56 of the wedges, raising the cap at the 40° angle, as described, until the cap is completely free of the finish.

In the reverse process, putting the cap on, the user will be able to "feel" the lugs center between the tops of the wedges 54 and the inclined surfaces 48. He will feel the axial ride down the surface 56 and the circumferential resistance up the surfaces 48 and, finally, over the "peaks" of the ridges 40 into the cavity under the catch portion 34 and against the stop rib 36.

Such tactile notification gives the user a clear understanding of the position of the lugs and helps him disengage the cap or securely lock it.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A trigger sprayer assembly comprising:

a. a trigger pump having a closure at its lower end, the closure comprising a partial top wall having a peripheral downward annular skirt, the skirt having spaced down from the top wall a pair of diametrically opposite inward lugs, the lugs each having an inwardly and upwardly inclined lower surface and a radial upper surface, b. a container including a cylindrical finish having an outer surface and an axis and having a mouth therein for passage therethrough of liquid in the container, the finish further including two outward bayonet provisions on the outer surface of the finish at diametrically opposite positions on the finish, the bayonet provisions each comprising a first rib-like stop portion extending parallel to the axis of the finish and a catch portion extending from the top of the stop portion circumferentially of the cylindrical finish to a distal end, the catch portion having an upper surface comprising an outwardly and downwardly sloping portion, and a lower surface generally radial of the finish, each catch portion being formed at its distal end with a downward rounded detent ridge parallel to the axis, the ridge having a ridge peak, the container further including two outward ramp provisions on the outer surface of the finish, the ramp provisions disposed at diametrically opposite positions on the finish between the bayonet positions, the ramp provisions each comprising a second rib-like stop portion extending parallel to the axis of the finish and a wedge-like shape extending from the second rib-like stop portion toward the distal end of the catch portion most proximate in a clockwise direction viewed from above the finish and having a sloping surface facing the distal end, the sloping surface extending from below the catch portion to above the catch portion and sloping at an angle to an imaginary circumferential line passing through the sloping surface, the second rib-like stop portion of one ramp provision being spaced in the clockwise direction from the first rib-like stop portion of the adjacent bayonet provision to define a space wherein at one rotary position of the cap one of the lugs may pass vertically freely between the first and second stop portions, and at another rotary position of the cap the legs may drop vertically a variable distance to the ramp provision, the sloping surface of the ridge affording an easy entry of the lugs under the catch all to give tactile notification to the user, the closure receiving the finish and the top surface of the lugs engaging the lower surface of the catch portion of the finish.

2. A trigger sprayer assembly as claimed in claim 1 wherein the top wall is formed with an annular wall which extends axially into the finish and sealingly engages the finish from inside.

* * * * *